US012442065B2

(12) United States Patent
Pearcey

(10) Patent No.: US 12,442,065 B2
(45) Date of Patent: Oct. 14, 2025

(54) SYSTEM AND METHOD FOR COATING OF CONTINUOUS SHEETS OF METAL

(71) Applicant: HATCH LTD., Mississauga (CA)

(72) Inventor: Owen Pearcey, Highvale (AU)

(73) Assignee: Hatch Ltd.

( * ) Notice: Subject to any disclaimer, the term of this patent is extended or adjusted under 35 U.S.C. 154(b) by 0 days.

(21) Appl. No.: 17/180,192

(22) Filed: Feb. 19, 2021

(65) Prior Publication Data

US 2022/0267885 A1 Aug. 25, 2022

(51) Int. Cl.

| | |
|---|---|
| ***C23C 2/20*** | (2006.01) |
| ***C23C 2/00*** | (2006.01) |
| ***C23C 2/40*** | (2006.01) |

(52) U.S. Cl.

CPC ..... *C23C 2/00348* (2022.08); *C23C 2/00344* (2022.08); *C23C 2/20* (2013.01); *C23C 2/40* (2013.01); *C23C 2/51* (2022.08); *C23C 2/52* (2022.08); *C23C 2/524* (2022.08)

(58) Field of Classification Search

CPC ..... C23C 2/20; C23C 2/40

See application file for complete search history.

(56) References Cited

U.S. PATENT DOCUMENTS 10,190,202 B2 1/2019 Fontaine

FOREIGN PATENT DOCUMENTS

JP 2970722 B2 * 11/1999
JP 2010520374 A * 6/2010 ..... C23C 2/14

OTHER PUBLICATIONS

JP-2010520374-A English translation. (Year: 2010).*
Saxinger et al. (NPL titled: Feedforward control of the transverse strip profile in hot-dip galvanizing lines, attached), Journal of Process Control 92 (2020) 35-49; Journal of Process Control; https://doi.org/10.1016/j.jprocont.2020.05.007 0959-1524/ © 2020 The Authors. Published by Elsevier Ltd. (Year: 2020).*
JP-2970722-B2 English translation. (Year: 1999).*

* cited by examiner

*Primary Examiner* — Hai Y Zhang
(74) *Attorney, Agent, or Firm* — Bordner Ladner Gervais LLP; Brandon Evenson

(57) ABSTRACT

A system and method for affecting the crossbow in a metal sheet in continuous coating process. The system comprises strip distance sensors for determining distances to the metal sheet. A controller is configured to adjust the position of the correcting roll, based on the strip distances, to affect the crossbow in the sheet to help control the thickness of the coating on the sheet. The system may comprise a crossbow model to help determine the new correcting roll position. The distances determined by the strip distance sensors may be also be used to adjust the position of the air knives.

16 Claims, 8 Drawing Sheets

SYSTEM AND METHOD FOR COATING OF CONTINUOUS SHEETS OF METAL

FIELD

This specification relates to continuous metal coating processes, including for example galvanization processes.

BACKGROUND

Sheets of metal (which can include strips of metal) may be coated with a material to provide the metal with certain desired physical properties. For example, sheets of steel may be coated with a protective zinc-based material in a process known as galvanization. The protective coating inhibits the sheet from oxidizing. Galvanized sheet metal is used for general applications and automotive applications, such as car doors and other exposed panels.

Conventional metal sheet galvanization process lines draw long coils of sheets or strips of metal from an annealing furnace through a coating bath. Rollers and other equipment may help guide a sheet continuously through the bath.

A coating bath typically consists of a molten zinc-based coating which provides the metal sheet with a protective coating that inhibits the sheet from oxidizing.

It is important to precisely control the amount or thickness of zinc-based coating on the metal sheet to achieve a uniform thickness. It is also important to limit the surface defects/imperfections in the coating.

In order to control the thickness of the coating on a metal sheet in a galvanization process, the sheet may pass between air knives after the coating bath. The air knives emit high pressure and high velocity gas directed at both sides of the metal sheet to remove the excess coating from the sheet and more evenly distribute the coating across the sheet. The molten coating metal that is stripped from the sheet is typically returned to the bath for re-use. Excessive coating, beyond the minimum requirements, increases material production costs with no functional benefits or way to recoup such costs in the market. Too little coating, or imperfections/defects in the coating, may result in the sheet not meeting certain industry specifications, and may require the product to be downgraded or even result in scrapped product.

The proximity of the air knives to the sheet and gas wiping pressures are the main parameters used to control the coating thickness. The metal sheet can, however, buckle, warp, bow around the area of the air knives as the sheet continuously passes between the air knives. This can cause a varying gap between the air knife and the sheet along the width, resulting in variations in coating thickness, and potentially imperfections in the coating surface. Typically, the closer the air knives are to the sheet, the better control of the coating thickness. But the closer the air knives are to the sheet, the greater the risk that sheet movement and/or deformation will result in the sheet hitting an air knife. This can block the air knife slot with coating material, potentially damage the air knife, introduce imperfections into the coating, and potentially require the shutdown of the entire galvanization line.

In order to guide the sheet into then out of the bath, the sheet is bent around a main roll within the bath. A main roll is often referred to as a sink roll. The main roll causes the sheet to change direction within the bath. This bending, however, causes a deformation in the metal sheet where the internal stress can exceed the yield strength of the metal. The metal sheet becomes compressed on the side contacting the roll, and elongated on the opposite side. When the yield strength is exceeded, plastic deformation can result in an unwanted crossbow (transverse warp) or deviation from flatness in the sheet. Importantly, among other issues, a crossbow in the sheet may result in a non-uniform thickness of the molten zinc-based coating to be applied through conventional air knife wiping methods employed on galvanizing lines.

To temporarily flatten a metal strip at the air knife for helping provide a more uniform coating distribution, electromagnetic stabilizers are sometimes used. For example, International Publication No. WO2020083682 describes contactless actuators with electromagnets that are positioned downstream of the air knife. The electromagnets create a magnetic field around the metal strip at the air knife to temporarily flatten the metal strip by reducing the crossbow. Electromagnetic stabilizers, however, are expensive to add to existing systems and require high electrical power to operate. This increases the costs of the coating operations and creates complexity and a higher likelihood of faults in the coating processes. Electromagnetic stabilizers further typically require using cooling water which may be a hazard around the liquid metal coating in the coating pot.

DETAILED DESCRIPTION

Figure 1:
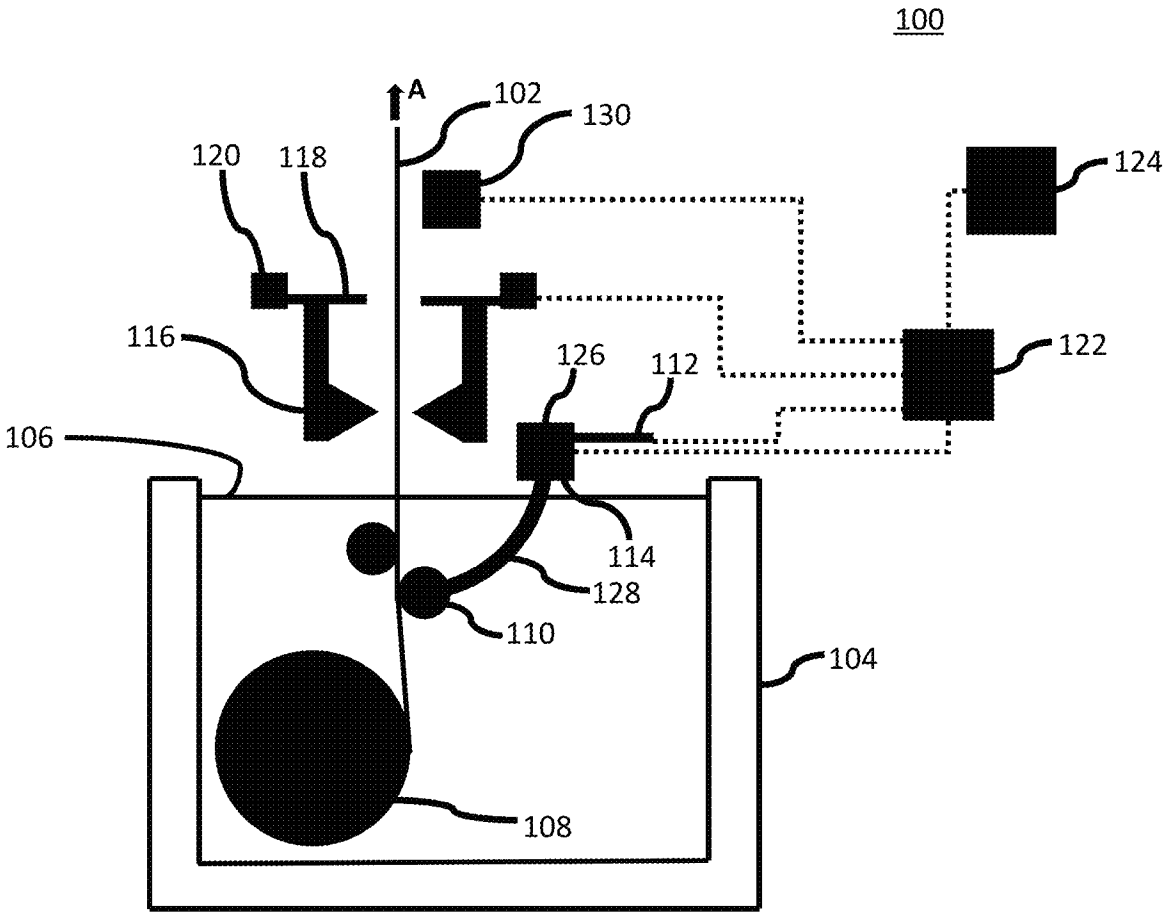
FIG. 1 depicts a continuous system for coating a metal sheet according to an embodiment of the present disclosure.

The present disclosure provides a system and method for helping eliminate or minimize a crossbow in a sheet at or proximate to the correcting roll(s) to better control coating thickness at the air knives. A strip distance sensor located at or near the air knives provide measurements which are used to determine the suitability of the position of a correcting roll for minimizing the crossbow in the sheet. The correcting roll is located proximate to the main roll. The sheet distance sensors may obtain measurements of three points across the width of the sheet to determine the crossbow in the sheet. The measurements may be input into a model to determine and select a correcting roll location to help minimize the crossbow. The measurements may also be used to adjust the location of the air knives.

In a method for coating a sheet according to an embodiment of this disclosure, the method comprises submerging a sheet in a coating bath; passing the sheet around a main roll in the bath to change the direction of travel of the sheet, the sheet compressing on the side contacting the main roll and elongating on the other side to result in a crossbow in the sheet when the yield strength of the sheet is exceeded; contacting the sheet with a correcting roll downstream of the main roll, the correcting roll altering the crossbow in the sheet; emitting, from an air knife a select distance from the sheet, high-pressure gas at the sheet, after contacting the sheet with the correcting roll, to affect the thickness of the coating on the sheet; taking sheet distance measurements to a plurality of points on the sheet transverse to the direction of travel of the sheet; re-positioning the correcting roll relative to the main roll based on the sheet distance measurements to alter the crossbow; and re-positioning the air knife based on the sheet distance measurements to alter the select distance of the sheet to the air knifes. Taking the sheet distance measurements may comprise taking measurements of the distance to three or more points across a width of the sheet. The method may further comprise varying the position of the correcting roll based on a crossbow model and the sheet distance measurements.

In another method for coating a sheet according to an embodiment of this disclosure, the method comprises submerging a sheet in a coating bath of coating material; contacting the sheet in the bath with a main roll and a correcting roll to alter the direction of travel of the sheet and alter a crossbow in the sheet; measuring distances to a plurality of points on the sheet downstream of the correcting roll; determining the crossbow in the sheet based on the distance measurements; and changing the correcting roll position relative to the main roll based on the distance measurements. Changing the correcting roll position relative to the main roll may be based on a crossbow model output. The crossbow model output may be based on the distance measurements. The method may further comprise changing the position of the air knife based on the distance measurements. Measuring the distances to the sheet may comprise emitting a laser beam at the sheet from a select location. Measuring distances to the sheet may comprise measuring at at least three points on the sheet, the points defining a line that is transverse to the direction of travel of the sheet. The method may further comprise adjusting both the position of the air knife and the correcting roll position.

In an embodiment of this disclosure, a method for coating a sheet, the sheet being submerged in a coating bath and passed around a main roll causing a crossbow in the sheet, comprises contacting the sheet with a correcting roll after the main roll; passing the sheet past an air knife downstream of the correcting roll; taking measurements of distances to the sheet at a plurality of points transverse to the direction of travel of the sheet downstream of the correcting roll; continuously adjusting the correcting roll position based on the measured distances to minimize the crossbow in the sheet; and adjusting the air knife position based on the measured distances. The method may further comprise taking the measurements of distances of the sheet at three or more points transverse to the direction of travel of the sheet. The measurements of the distances may be taken relative to the position of the air knife.

In an embodiment of this disclosure, a system for coating a sheet comprises a main roll submerged in a coating bath; a correcting roll downstream of the main roll; an air knife downstream of the correcting roll, the air knife having air knife jets for emitting high-pressure air at the sheet, after the sheet has been coated in the coating bath, to affect the thickness of the coating on the sheet; a strip distance sensor configured to take readings of distances to the sheet; and, a controller configured to receive the readings from the strip distance sensor and adjust the position of the correcting roll based on the strip distance sensor readings to help minimize the crossbow in the sheet. The controller may adjust the position of the air knife based on one or more of the readings from the strip distance sensor. The system may comprise two or more correcting rolls.

In another embodiment of the present disclosure a controller for a sheet coating system having a coating bath, a main roll, a correcting roll downstream of the main roll, and air knives, is configured to repeatedly obtain readings of distances to a sheet at a plurality of points transverse to the direction of travel of the sheet in the coating system; calculate a desired correcting roll position using the obtained distance readings and a crossbow model to minimize the crossbow in the sheet; and, send control signals to the sheet coating system, based on the calculated desired correcting roll position, instructing the system to adjust the position of the correcting roll to reduce the crossbow in the sheet. The controller may be further configured to send control signals to the system, based on the obtained distance readings, to adjust the position of the air knife relative to the sheet to modify the thickness of the coating on the sheet. The controller may be connected to a means for taking distance readings that repeatedly takes readings of the distances to the sheet.

In another embodiment according to this disclosure, a method for coating a sheet, the sheet being submerged in a coating bath and passed around a main roll causing a crossbow in the sheet, comprises contacting the sheet with a correcting roll after the main roll; passing the sheet through air knives after the correcting roll; repeatedly obtaining sheet distance measurements at a plurality of points transverse to the direction of travel of the sheet; calculating a correcting roll position using the sheet distances and a crossbow modeling curve; and, sending control signals to the correcting roll to adjust the position of the correcting roll to provide a minimum crossbow or a zero crossbow in the sheet. The sheet distance measurements may be obtained at the air knives or downstream of the air knives. The method may further comprise calculating a sheet coating thickness distribution based on the sheet distance measurements. The method may further comprise determining a crossbow in the sheet based on the coating thickness distribution or the sheet distance measurements. The method may further comprise re-positioning the air knives based on the sheet distance measurements.

FIG. 1 shows a system 100 for coating a metal sheet 102 according to an embodiment of the present disclosure. The system comprises a bath vessel 104, which may also be referred to as a pot, containing a liquid metal 106 for coating the metal sheet and a main roll 108 positioned within the bath vessel 104. The main roll 108 may also be referred to as a sink roll throughout this disclosure. The sheet 102, which may also be referred to as a strip, wraps around the main roll 108 in the bath vessel 104 thereby causing the sheet 102 to change directions so it can be drawn in to, then out, of the bath vessel 104 in the direction of travel A.

The system 100 also comprises one or more moveable correcting rolls 110. The correcting rolls 110 are within the bath vessel 104 and downstream (in the direction of travel A of the sheet 102) of the main roll 108. Correcting rolls may also be referred to as secondary rolls, stabilizer rolls, or passline rolls throughout this disclosure. As shown in FIG. 1, the correcting roll 110 contacts the sheet 102 after the main roll 108 contacts the sheet 102. In the configuration of the system 100, the main roll 108 contacts the sheet on a first side of the sheet, and the correcting roll 110 contacts the opposite side of the sheet. The contact of the correcting roll may be immediately after the contact of the main roll. In this way, the correcting roll 110 may deform the sheet 102 opposite to the deformations caused by the main roll 108. This opposite deformation help reduce the crossbow in the sheet that may be caused by the main roll 108. If there are multiple correcting rolls, at least one of the correcting rolls contacts the sheet 102 on the side that is opposite to the side of the sheet that is contacted by the main roll 108.

Each moveable correcting roll 110 is associated with one or more actuators 112 and one or more correcting roll position sensors 114. The actuators may be attached to a beam 126 outside of the pot, the beam 126 connected to arms 128 extending into the pot and connected to the correcting roll 110. The actuators 112 can mechanically move or adjust the position of the correcting roll relative to the main roll 108 by actuating the beam. The position of the correcting roll supported by the beam may be determined based on a known distance between the front face of the correcting roll and the beam mounts. The distance between the position of the main roll and the position of the correcting roll may be determined during set up of the rolls outside of the pot. The actuators can move or adjust the beam 126 based on electronic signals received from the controller. The correcting roll may be moved from left to right (towards or away from the sheet) by adjusting the horizontal position of the beam, or the whole beam supporting the correcting roll may be rotated to cause the correcting roll to pivot towards or away from the sheet. The one or more correcting roll position sensors 114 detect the position of the correcting roll or beam relative to the main roll. The correcting roll position sensors 114 may be integrated with the correcting roll actuators 112. The actuators may be, for example, servomotors such as rotary or linear actuators that include a motor with sensor for position feedback. In other examples, the actuators and the correcting roll position sensors may be independent.

A set of air knives 116, for example two air knives, for emitting high-pressure gas are positioned downstream (in the direction of travel A of the sheet 102) of the last correcting roll and outside of the bath vessel 104. The air knives 116 comprise jets or nozzles which are directed at the surface of the sheet 102. The high-pressure gas is emitted from the jets/nozzles at the surface of the sheet 102. The internal pressure of the air knife 116 is regulated. The position of the air knives 116 may be adjusted by actuators 118 coupled to the air knives 116. Similar to the correcting roll actuators, the air knife actuators may be, for example, servomotors such as rotary or linear actuators that include a motor and air knife sensor 120 for position feedback. In other examples, the actuators and the air knife sensors may be independent.

An array of strip distance sensors 130 are disposed on or near the air knives. The strip distance sensors take measurements of the distance from a select point to the metal strip at or proximate to the area of the strip where the air knives are directing air. The measurements obtained by the strip distance sensors 130 are used to determine the crossbow in the metal sheet at the point of measurement. The measurements obtained by the strip distance sensors may also be used to determine the position of the metal strip relative to the position of the air knifes. The measurements may be used to determine the distance between the strip and the air knives. The strip distance sensors 130 may determine distances to the surface of the metal sheet 102 at one or more points across the width of the metal sheet 102 that passes past the strip distance sensor 130. One or more strip sensors may be used to determine the distances to the sheet.

The system 100 also comprises a controller 122. The controller 122 is in communication with the correcting roll actuators 112, the correcting roll position sensors 114, the air knife actuators 118, and the air knife sensors 120 and the strip distance sensors 130. The controller 122 is also in communication with a programmable logic computer (PLC) 124.

Figure 2:
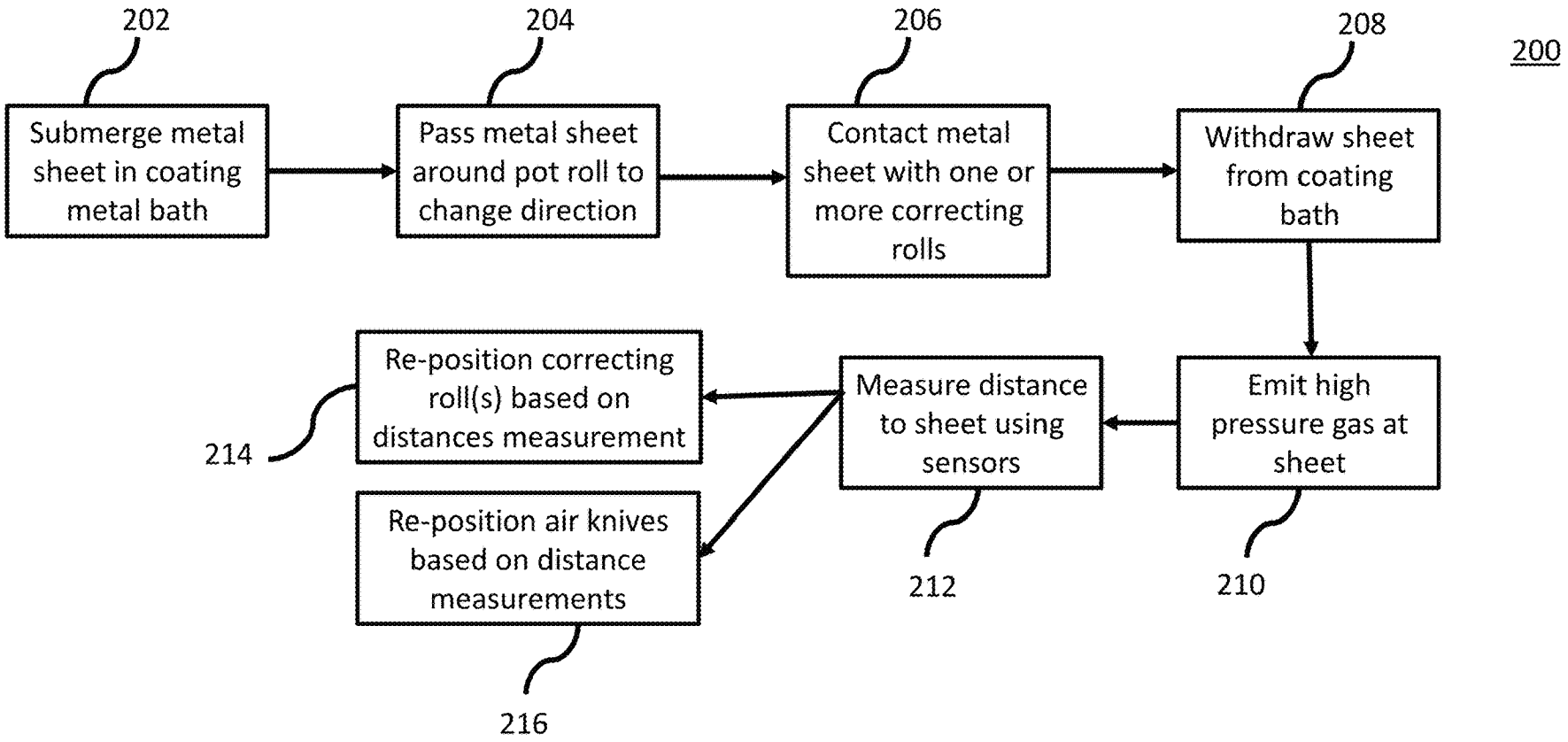
FIG. 2 is a box diagram of a metal coating process according to an embodiment of the present disclosure.

FIG. 2 depicts an example coating process 200 using the system 100. The coating process may comprise 202 submerging the metal sheet 102 in the coating metal 106 in the bath vessel 104, 204 passing the metal sheet 102 around the main roll 108 to cause the sheet 102 to change its direction of travel, 206 contacting the sheet 102 with a correcting roll or rolls 110 to deform the sheet 102 opposite to the deformation caused by the main roll 106, 208 withdrawing the sheet 102 from the bath vessel 104, 210 emitting high pressure gas from the air knives 116 at the sheet 102 to modify the thickness of the coating, 212 measuring distances to the sheet using a strip distance sensor 130 at a plurality of points transverse to the direction of travel A of the sheet 102 or by analysis of the coating thickness distribution, 214 re-positioning the correcting roll(s) 110 to help mitigate crossbow based on the measurements, and optionally 216 re-positioning the air knives 116 based on the same measurements from the strip distance sensors 130. Re-positioning the air knives 216 may also be based on measurements of the position of the air knife from the air knife sensors 120.

Passing the metal sheet 102 around the main roll 108 comprises contacting the side of the sheet facing the top of the bath with the main roll and bending the sheet around the main roll. As the sheet wraps around the main roll, the sheet metal compresses along the side contacting the roll and stretches along the opposite side, resulting in a crossbow or transverse warp in the sheet if the internal stresses caused by bending exceed the yield point of the sheet material.

The correcting rolls 110 downstream of the main roll are contacted against the sheet 102, to counteract or reverse or impart some correction to the internal stresses and therefore the crossbow effects caused by the main roll 108. The degree and effectiveness of the crossbow correction by the correcting roll(s) 110 depends on the position of the correcting roll 110 (or rolls) and other environmental factors. The correcting roll position sensors 112 communicate with the controller 122 to relay the position of the correcting roll. The strip distance sensor 130 communicates with the controller to relay the position of the sheet between the air knives or relative to another known point. The controller 122 signals the correcting roll actuators 112 and the air knife actuators 118 to adjust the position of the correcting roll 110 and the position of the air knives 116, as necessary. In an example, one or more correcting rolls may be positioned upstream of the main roll in the direction of travel A of the sheet.

The air knives 116 emit high-pressure air/gas at the sheet 102, to modify the thickness of the liquid coating on the sheet 102 as the sheet 102 emerges from the bath vessel 104 and before the liquid coating dries. Modifying the thickness of the coating on the sheet may comprise making the thickness of the coating more even across a select area of the sheet, such as a portion of the sheet that is transverse to the direction of travel of the sheet. The air knives 116 may be located above the liquid metal bath vessel 104 so that excess liquid coating is blown off of the metal sheet and back into the metal coating bath 106. Changes in the correcting roll 110 position however may cause the effective passline of the sheet (i.e. the position of the metal sheet between the air knives) to vary which may cause the sheet to have uneven coating between the two sides or may cause the sheet to contact an air knife, blocking the air knife nozzle and requiring cleaning or even shut down of the system. At least one of the strip distance sensors 130 may be used to determine changes in the passline. The strip distance sensor measurements may be taken continuously or periodically. The gap or distance measured between the air knives and the coated metal sheet passing between the air knives may be communicated to the controller 122 and a control signal may be relayed to the air knife actuators 118 to adjust the position of the air knives. Air knife actuators 118 in communication with the controller 122 mechanically adjust the air knife nozzle position radially away from or towards the sheet. For example, the actuators 118 may cause the air knife 116 on one side of the sheet 102 to move away from the sheet as the passline shifts in the direction of or towards that air knife, while moving the other air knife towards the sheet to maintain an equal distance between the sheet and both air knives to allow effective control of the coating on the sheet without coming into contact with the sheet. In another example, the air knife actuators 118 may pivot the air knife such that one end of the body of an air knife moves in a direction towards the sheet and the other end moves in a direction away from the sheet to correspond with one or both of a passline shift and varying metal coating thicknesses due to a crossbow in the sheet. The actuators 118 may also be configured to move the air knives to maintain a predetermined distance from the coated metal sheet 102. For example, the predetermined distance may be a distance sufficient to avoid the possibility of contacting an air knife nozzle with the coating metal on the surface of the sheet while continuing to effectively wipe excess coating off of the sheet. The controller 122 may provide a real-time or near real-time signal to the actuators 118 to reposition the air knives based on the varying passline position. The air knife on one side or on both sides of the sheet may be adjusted during the coating process to track the changes in the passline in real or near real time.

The strip distance sensors 130 positioned on or near the air knives, for example proximate to but downstream of the air knives, may use a light source for determining the distances to the metal sheet 102. For example, the strip distance sensors 130 may comprise a light source such as a laser, or an infra-red or LED light source. The sensors 130 may be configured to measure the distance to the sheet 102 by emitting a laser beam, or similar light beam, at the sheet 102 at an angle to the perpendicular of the surface of the sheet 102. For example, strip sensors similar to those described in U.S. Pat. No. 10,288,423 and/or 10,408,767, which are incorporated herein by reference, may be used.

In an embodiment, strip distance sensors 130 take measurements to the distance of the surface of the coated sheet. These measurements may be taken from sensors located on either or both sides of the sheet 102 from at least three positions along the width of the sheet. The three positions along the width of the metal sheet may include a central position, and a position on each opposite side of the central position along the width of the sheet. Additional sensors may be added to increase the accuracy of the detected strip position or shape. More sensors may also increase the probability of detecting a sheet edge in the case where the coating system receives sheets with different widths. In an embodiment, the controller receives the strip distance measurements and determines the magnitude and/or amount of a crossbow in the sheet based on differences between the distances measurements taken at the center or middle of the sheet and the measurements taken at the edges of the sheet.

Figure 3:
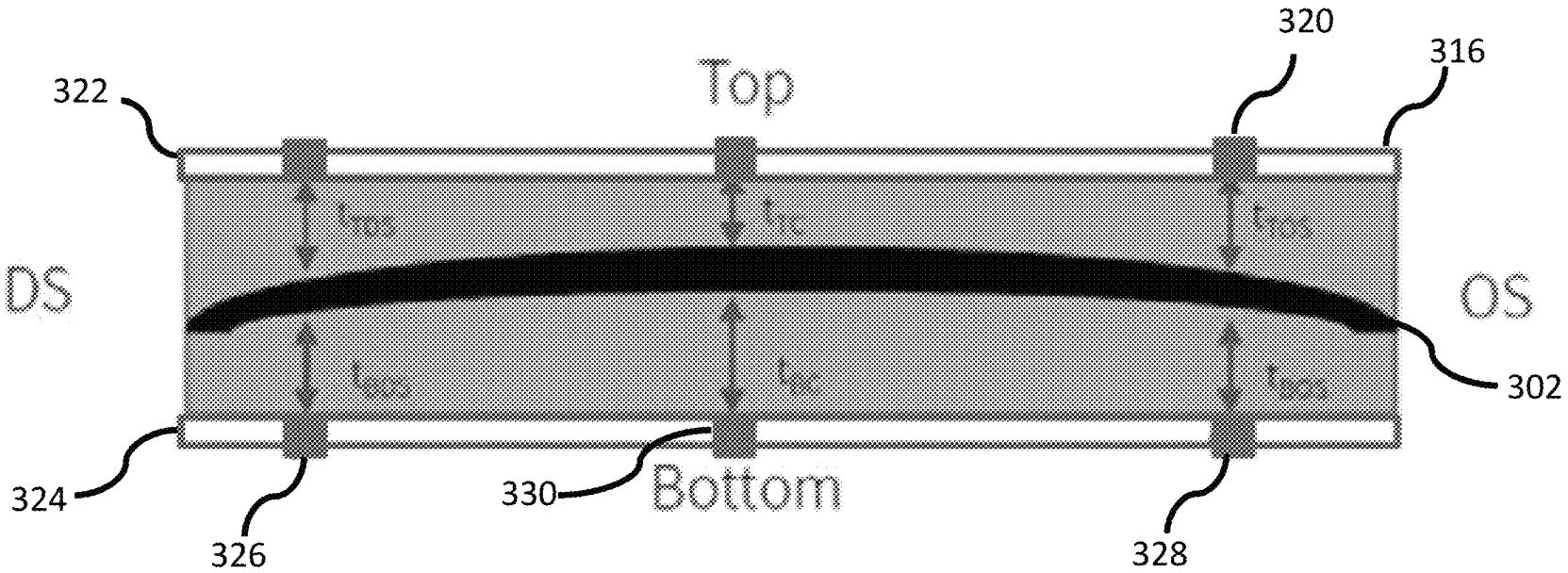
FIG. 3 depicts a cross-section of a coated metal sheet with a crossbow between a set of strip distance sensors according to an embodiment of the present disclosure.

FIG. 3 depicts a cross-section of a coated metal sheet 302 with a crossbow passing between the strip distance sensors located on the air knives 316 according to an embodiment of the sheet coating process of the present disclosure. Three sensor pairs are positioned along the width of the sheet, with each pair of sensors comprising a sensor on the top air knife 322 aligned with a corresponding sensor on the bottom air knife 324 (orientation as depicted in the figure). In an embodiment, a single sensor instead of a sensor pair may be used. The single sensors may all be along the same side of the sheet. Or the single sensors may be on both sides at different points along the length of the air knives. More sensors may be added along the length of the air knife(s) to increase the accuracy of the crossbow determination. One or more sensors may be positioned to take distance measurements near the drive side of the coating system 326, one or more sensors may be positioned to take distance measurements near the operator side of the coating system 328, and one or more sensor may be positioned to take distance measurements at or near the center 330 of the coated sheet between the drive side and the operator side. The crossbow in the sheet may be determined through the differences in the individual distance measurements along the sheet width. In an embodiment, a difference in metal coating thicknesses along the width of the sheet may indicate and be used to determine a residual crossbow in the sheet. For example, the strip or passline position, in combination with the pressure of the air knife emission and other operating parameters may be relayed to the controller and used by the model to calculate a theoretical thickness of the coating on the sheet. An analysis of this coating weight feedback, as determined for example using the six coating weight values corresponding with the points indicated in FIG. 3, can be used in place of an actual crossbow measurement. A residual crossbow may be any remaining transverse warp in the sheet after the sheet has been contacted with the correcting roll. In another example, only sensors on the top air knife or only sensors on the bottom air knife may be used to take distance measurements to the sheet. In another example, the sensors may be on only one side or on both sides of the sheet, but positioned downstream of the air knives in the direction of travel. The resulting distances across the width of the sheet taken from sensors along one air knife or along one side of the sheet, taken at the same time, may be used to determine a crossbow in the sheet by the variance in the measured distances between the surface of the sheet and the air knife, or other known position. These distance measurements may provide model validation and/or a closed loop feedback for adjusting the strip shape using the sensitivity gain derived from the crossbow model output. The control system may use the measured residual crossbow to signal an adjustment of the correcting roll position to minimize or eliminate the crossbow in the sheet and an adjustment of the air knife position to inhibit contact with the coated sheet.

The controller 122 is configured to determine a required adjustment to the correcting roll 110 position based on the determined residual crossbow and a crossbow model received from the PLC 124. The PLC 124 of the system 100 is programmed with a model for determining an expected crossbow in a metal sheet being coated based on the correcting roll position relative to the main roll position and taking into account many other factors and/or parameters. A representation of inputs to the model and corresponding output from the model may be depicted on a plotted curve for ease of explanation.

Figure 4:
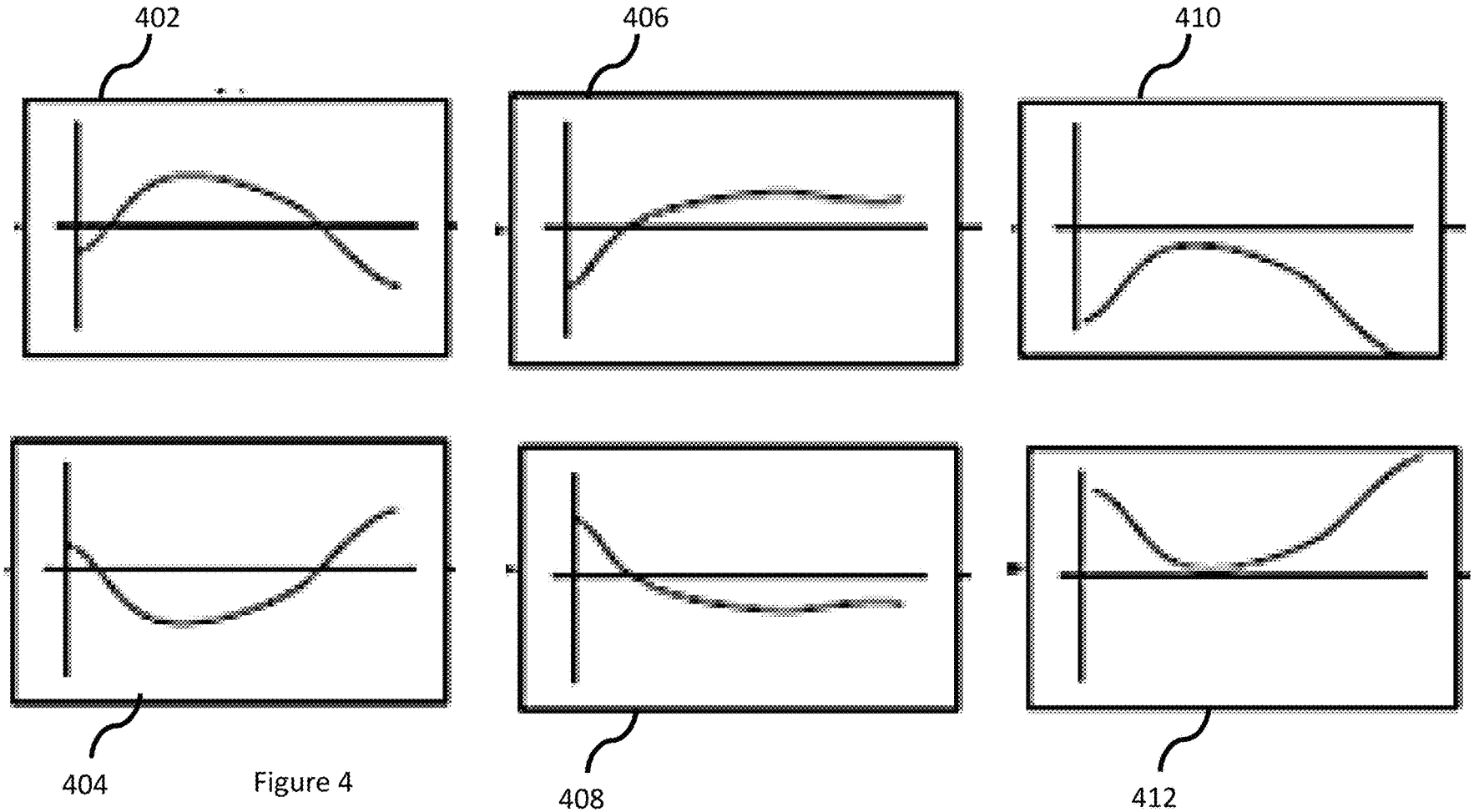
FIG. 4 depicts six representative potential solution curves based on a model output according to an embodiment of the present disclosure.

FIG. 4 depicts six representative solution curves for crossbow compared to the correcting roll position (i.e. representative of model output) depending on the roll configuration, material properties, operating line parameters, and other environmental factors inputted to the PLC. For ease of depiction and understanding, the model output may be plotted as a crossbow measurement (y-axis) against a correcting roll position (x-axis) such that a zero intercept defines the correcting roll position that would theoretically result in a zero crossbow in the sheet. Six possible solution curves are depicted in FIG. 4, however the model output may be depicted by other solution curves not depicted in FIG. 4. The six solutions shown in FIG. 4 include the normal and inverse (depending on the model input configuration being employed) of three types of curves: (1) two solutions for the correcting roll intermesh position where zero crossbow can be achieved 402, 404, (2) a single solution for the correcting roll intermesh position that achieves zero crossbow 406, 408, (3) no solution for the correcting roll intermesh position that achieves zero crossbow 410, 412 (in this case, the curve provides a solution that achieves a minimum crossbow). Where more than one solution for a zero crossbow exists 402, 404 a solution may be selected by an operator or automatically by the PLC or controller.

The model inputs may include parameters related to both the bath vessel, and the sheet material to be coated. For example, bath vessel parameters inputted to the model may include the placement of the main roll in the bath vessel and the configuration of the correcting roll or rolls relative to the main roll and relative to one another. The sizes of each roll may also be considered. The diameter of the main roll may be several times greater than the diameter of the correcting roll. Larger rolls impart a smaller deformation onto the strip while smaller correcting rolls can aid correction of the deformation by position adjustment. When more than one correcting roll is used, the correcting rolls may be the same or different sizes. Additional input parameters include the possible correcting roll intermesh positions and offset, the angle in degrees from the furnace exit roll to the sink roll, Young's modulus at the pot temperature and yield strength for the sheet material at the pot temperature. The possible movement geometry of the correcting roll is also considered, for example whether the correcting roll can be moved only from left to right, only up and down or in a pivoting arrangement. In addition, the model receives specific parameters for each sheet before each sheet is submerged in the bath. Sheet parameters may include for example sheet thickness, sheet width, tensile stress, and work hardening factor. In some cases, consecutive sheets may have the same parameters in which case the model results will not change between sheets.

However, in cases where consecutive sheets have different parameters, the model may receive data (such as new or updated parameters) and provide updated outputs. The model may receive data, and provide updated outputs based on that data, in real time or near real-time. For example, where consecutive/adjacent sheets have different parameters (such as thickness) the model may be provided with the thickness of the subsequent sheet, and the model may then output different data to account for the differences of the subsequent sheet. The model may be provided with the subsequent sheet data in real-time before the sheet enters the bath. For example, the tail end of one length of a sheet may be welded to the head end of the next length of sheet in the reel to provide a continuous process that does not require re-threading new rolls through the line, but the welded sheets may have different parameters. The model may be run, with new data being provided, to account for any variations in any of the input parameters. The model may be run continuously or periodically only when a current sheet with different parameters than a previous sheet is set to be coated. The type of metal coating used may also be a parameter that is input into the model and which could change the model output.

The model may be inputted with constraints of the coating line. For example, the coating line and correcting roll position may be constrained by a maximum and minimum correcting roll position delineated by the size of the bath vessel and height configuration of the main roll(s) relative to the correcting roll and limits based on empirical experience. The minimum amount of intermesh required to set enough traction from the sheet to keep the roll turning if the roll is not driven by other means is also considered because if the roll stops turning, the roll may scratch the sheet as it runs over the non-rotating roll face. Too much intermesh may result in an undesirably high load on the bearings of the roll which may lead to increased wear and poor running and may reduce the usefulness of the roll and reduce service life. The model can be used to determine the correcting roll position within the maximum and minimum positions that would provide a minimum or zero crossbow.

Figure 5:
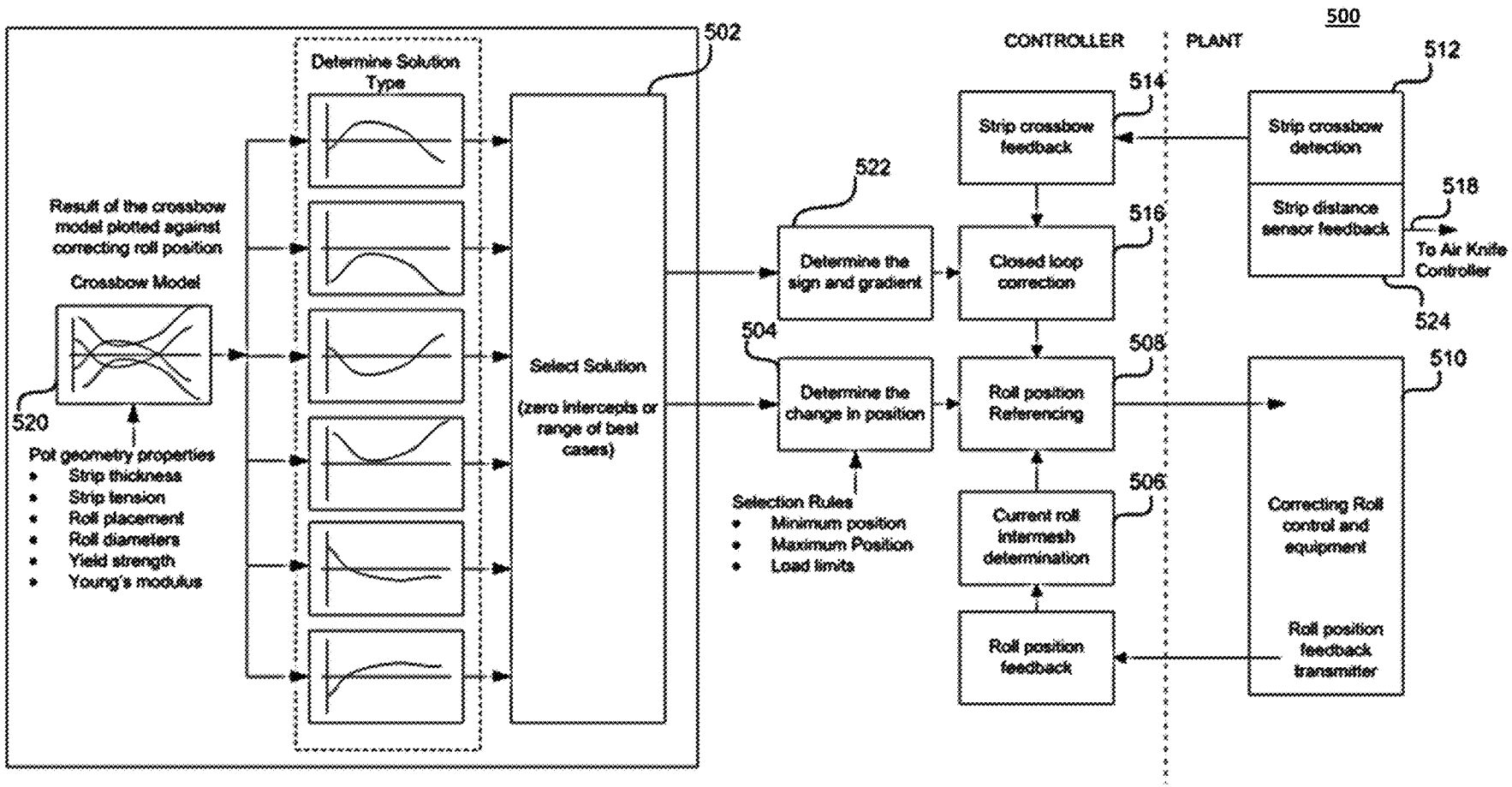
FIG. 5 is a box diagram depicting a process for coating a metal sheet according to an embodiment of the present disclosure.

FIG. 5 is a box diagram 500 depicting a process for coating a sheet according to an embodiment of the present disclosure with a system similar to the system 100 shown in FIG. 1. The process comprises the steps of determining a crossbow model output 502, determining a correction to the correcting roll position reference 508 based on an initial correcting roll position 506 and the model output reference 504, adjusting the correcting roll position 510, drawing the sheet through the system, taking strip distance sensor measurements to the coated sheet 524 to determine a residual crossbow or shape of the sheet 512, and adjusting the position of the correcting roll via a closed loop correction 516 based on the residual crossbow feedback 514 and the sign and slope of the process sensitivity 522 to determine a correcting action to minimize or eliminate the crossbow. The process further comprises obtaining strip distance sensor measurements 524 and determining the strip position 518 and controlling the position of the air knives.

The crossbow model output may be determined by the PLC. The PLC runs the model 520 (also referred to as modelling) based on, among other input parameters, bath vessel parameters and the sheet parameters. The modeling may be done before the metal sheet enters the bath. After selecting a solution 502, the PLC relays the selected zero or minimum crossbow solution to the controller. Alternatively, the controller selects a solution from the multiple solutions/output provided by the PLC to the controller. The controller determines the corresponding correcting roll position 508, based on the data from the model, to signal the correcting roll actuators to adjust the position of the correcting roll. The correcting roll position may be determined for the new sheet before the new sheet arrives at the pot. The adjustment or correction of the correcting roll position may be coordinated with the strip transport through the process line, for example taking into account the line speed and properties of the incoming strip.

The initial correcting roll correction provides an ideal zero or minimum crossbow for the metal sheet based on the parameters of the system and the model. However, an ideal position for the correcting roll may not practically result in a zero or minimum crossbow. The model may not account for every possible variable that could affect the crossbow in the sheet. Furthermore, a change in any of the input parameters to the model, or a change in the surrounding environment, may result in a residual crossbow despite the sheet contacting the correcting roll at the initial corrected position. The strip distance sensors collect sheet passline position measurements downstream of the correcting roll and relay the data to the controller. The data provides feedback on actual or true sheet passline and the sheet shape, including the existence of a residual crossbow. Using the sign and gradient of the selected model solution and the measured crossbow, the controller can determine any additional changes to the correcting roll position required to help eliminate or minimize the residual crossbow in the sheet. The correction may be based on the residual crossbow detected by the strip distance sensors or by analysis of the measured coating thickness.

Furthermore, by detecting the passline position and knowledge of the air knife position, the gap between the sheet and the air knives may be determined. The controller may signal an adjustment in the position of the air knives to avoid contact of the air knife nozzles or jets with the coated metal sheet. This can also maintain the desired coating thickness by repositioning the air knives in response to a passline change caused by the correcting roll movement.

Figure 6:
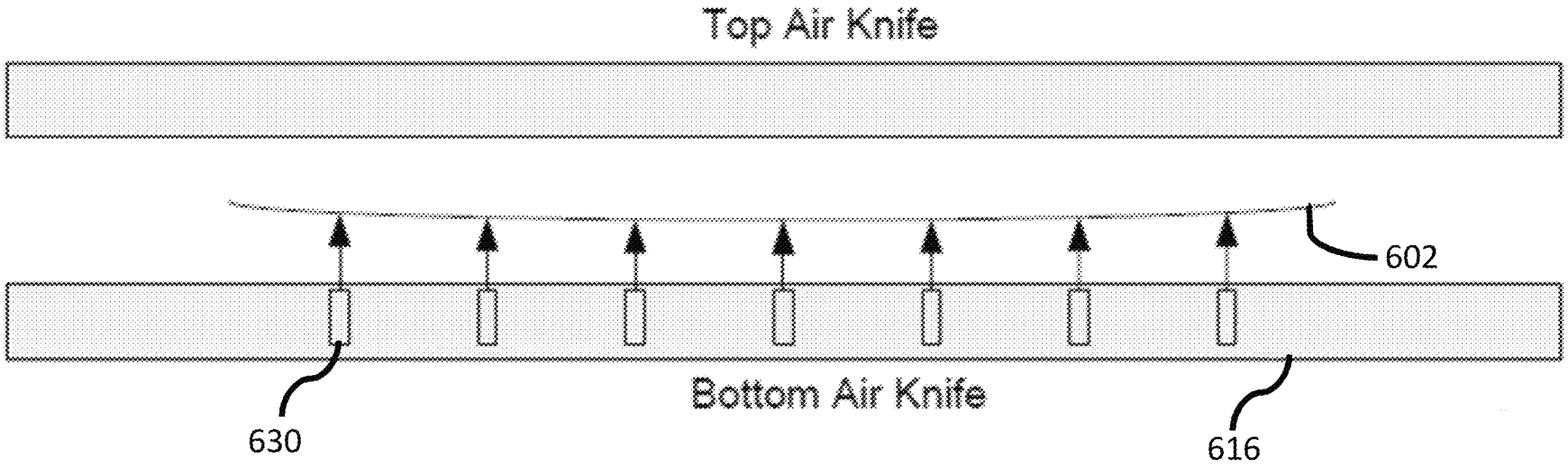
FIG. 6 depicts an array of strip distance sensors at the air knives according to an embodiment of the present disclosure.

FIG. 6 shows an array of strip distance sensors 630 disposed on the air knife 616 and configured to obtain sheet 602 position measurements at a plurality of points transverse to the direction of travel of the sheet, for example points along the width of the metal sheet. In this example, the strip distance sensors 630 are positioned directly on the air knife, however in other examples, the sensors may be downstream of the air knife. To measure a residual crossbow in the sheet, the sensors may obtain and provide the controller with sheet distance measurements taken by the sensors simultaneously along the width of the sheet. Where at least three distance measurements are taken at the same time, they can be used by the controller to determine the existence of a residual crossbow in the sheet and determine the extent of the crossbow. The sheet crossbow feedback from the sensors and the sign and gradient of the selected solution from the model may be used to determine a correcting roll position correction/position. The controller may compare the existing correcting roll position to the further corrected position calculated from the model and signal the correcting roll actuators to adjust the position of the correcting roll based on the determined correction. The model may be continuously re-run throughout the coating process to account for any parameter changes in the system, process or the metal sheet that occur during runtime. For example, a change in the sheet tension may alter the model outputs. The controller may therefore compare a detected crossbow in the sheet with the immediately available model solution that takes into account the current (or real-time) parameters of the system, to determine the required correction. The correcting roll position may be adjusted while the sheet is submerged in the pot and in contact with the roll.

Typically, the last roll which a metal sheet contacts while going through the system 100 in a galvanization process determines the theoretical passline of the sheet. The theoretical passline may be subtly different from the point in space where the strip physically passes between the air knife jets, known as the effective passline. Continuous feedback of the effective passline position to the controller can help ensure that the air knives are sufficiently spaced from the coated sheet at all times to maintain a desired coating thickness and inhibit contact of the metal coating with the air knives and thereby avoid blocking the air knife slot or otherwise altering the air knife functionality. Adjusting the correcting roll as previously described to manage the crossbow may induce a change in the strip position at the air knife increasing this potential for contact of the coating with the air knives. At least one strip distance sensor can be used to determine or track variations in the effective passline of the sheet by taking continuous or periodic strip distance measurements. In other examples, multiple sensor measurements may be used. The strip passline changes induced by the correcting roll movement may be used by the controller to signal the air knife positioning control or actuators to move the air knives in real-time to correspond to the movement of the passline such as to inhibit contact of the coated sheet with the air knife and maintain the desired coating thickness. The passline measurement by the strip distance sensor may be continuously collected and relayed in real time to the controller to control the air knife adjustments, including air knife position and pressure, throughout the process. This sensing process can eliminate the delay associated with using passive coating weight gauge measurements downstream of the air knives to detect passline errors and can provide a dynamically reactive (to the strip movement) coating control system.

Figure 7C:
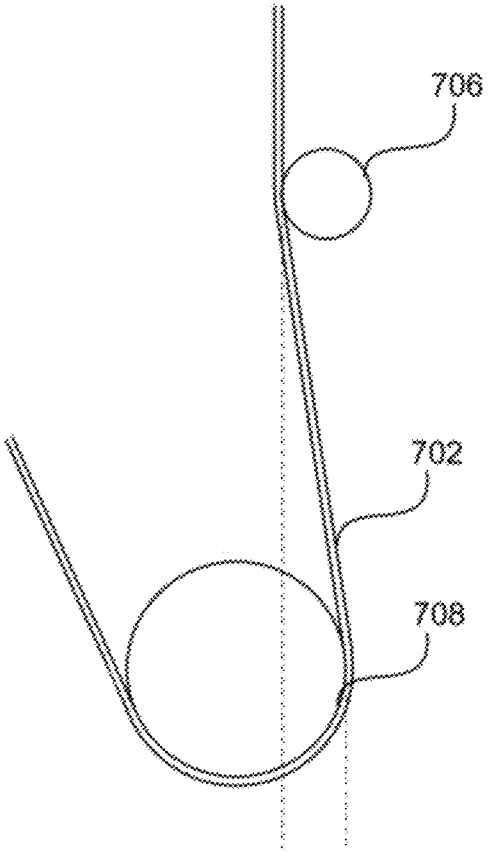
FIG. 7C is a representation of a roll configuration comprising a main roll and one correcting roll according to an embodiment of the present disclosure.
Figure 7B:
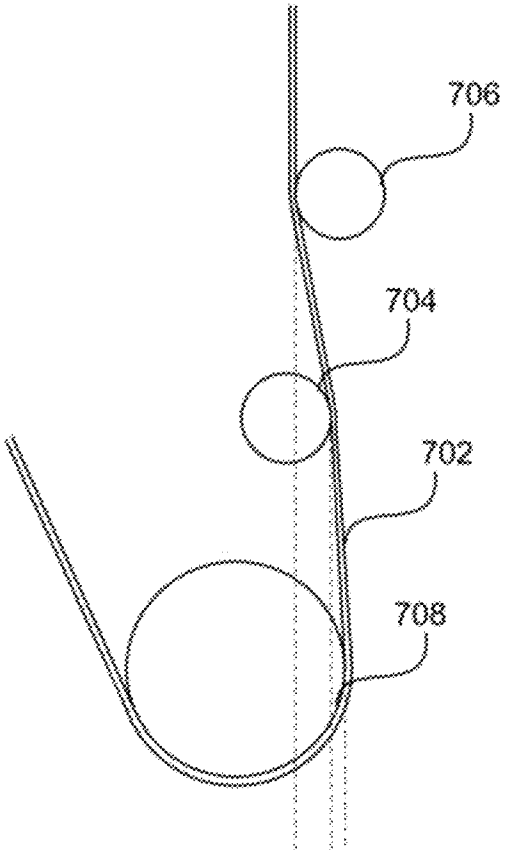
FIG. 7B is a representation of a roll configuration comprising a main roll and two correcting rolls according to an embodiment of the present disclosure.
Figure 7A:
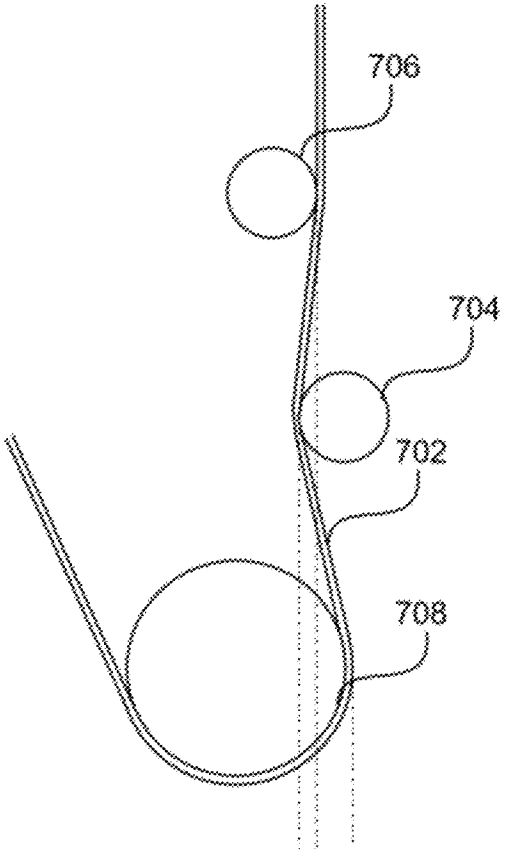
FIG. 7A is a representation of a roll configuration comprising a main roll and two correcting rolls according to an embodiment of the present disclosure.

FIGS. 7A-C show three example roll configurations for a metal sheet coating process according to embodiments of the present disclosure. FIGS. 7A and 7B each comprise a main roll and two correcting rolls, while FIG. 7C shows a main roll and a single correcting roll. In each figure, the position of the correcting roll farthest from the main roll (i.e. the last roll 706 in the pot/bath) determines the theoretical passline of the sheet between the air knives. In FIGS. 7A and 7B, either of the correcting rolls after the main roll (i.e. the middle roll 704 or the final roll 706 in these configurations) may be moved to the left or right (in the orientation of the figure), in order to deflect the strip 702. In some cases, the last roll 706 may be adjusted in coordination with the middle roll 704. In the three roll cases, the theoretical passline is largely set by the final roll 706 and is affected to a much lesser degree by the moving middle correcting roll 704 and in the opposite direction to the direction of travel. In FIG. 7C, the single correcting roll is also the final/last correcting roll 706 and may be moved for example to the left or right (in the orientation of the figure). The theoretical strip passline is directly set and affected by the movement and position of the final correcting roll 706. In another example, the moving correcting roll, whether a middle or final roll, may comprise a pivoting arrangement where the roll may be moved from left to right or up and down or in an angled direction. The theoretical passline provides a starting point for setting the air knife distances, while the strip distance sensor measured effective passline provides real-time data for adjusting the air knife position as the passline varies due to changing coating line process or sheet parameters or other environmental factors.

Figure 8B:
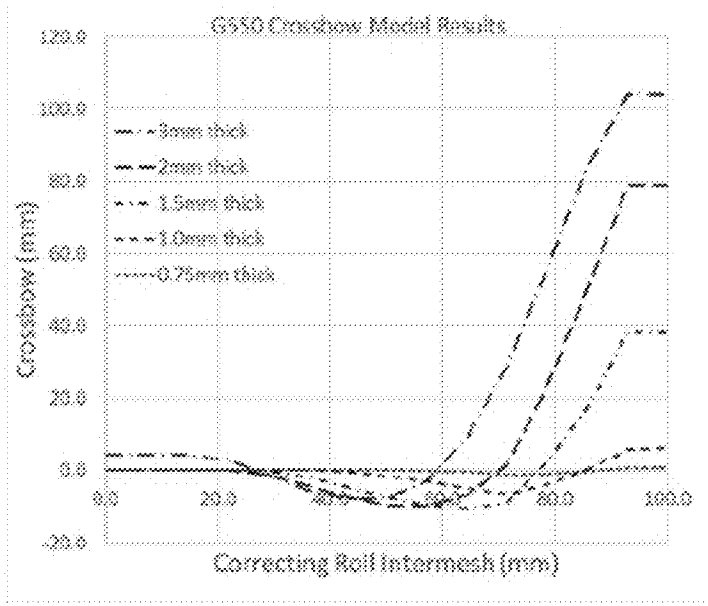
FIG. 8B is a representative crossbow model output for varying sheet thicknesses in a system and method according to an embodiment of the present disclosure, for a product of different material properties than that shown in FIG. 9A.
Figure 8A:
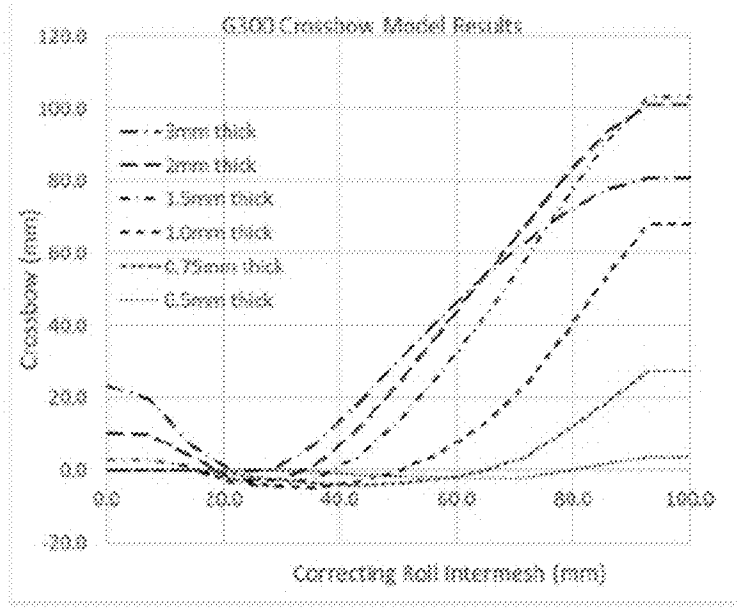
FIG. 8A is a representative crossbow model output for varying sheet thicknesses in a system and method according to an embodiment of the present disclosure.

FIGS. 8A and 8B show examples of a crossbow model output based on a three roll pot arrangement, for strips of 300 MPa and 550 MPa yield strength materials that are 1000 mm wide. The model was used to calculate the crossbow solution curves for 300 MPa and 550 MPa material, run with a strip tensile stress of 10 MPa and 12 MPa respectively. The zero intercepts shown in each graph give the intermesh positions that result in zero crossbow. The gradient of the line at the zero-intercept gives the change in crossbow effect as a function of correcting roll position/intermesh. For each of the cases depicted in FIGS. 8A and 8B, the resulting curves show that there are two solutions for correcting roll position that may eliminate crossbow and achieve flat strip. However, both solutions have different gradients, therefore the gains required for adjusting the position of the correcting roll will be different. The controller may automatically select one of two solutions or the solution may be selected by an operator.

The controller according to the present disclosure may be described as comprising feedback and feed-forward controls. The feed-forward control system manages the possible multiple solutions from the PLC crossbow model output. The crossbow curve is analyzed by the control system to determine the solution(s) and the gradient of the curve at the zero crossing. The operator (or if automated, the system) can select a solution, when more than one solution exists. Prior to the weld/strip approaching the pot, a new crossbow curve may be calculated and, as the strip approaches the pot, the new correcting roll position (intermesh) can be applied. The sheet on which the model is based is then submerged in the bath and around the re-positioned correcting roll to provide a zero or minimum crossbow in the sheet. Due to changes in the environment or other real world factors, additional adjustments to the correcting roll position may be necessary or desired throughout the coating process. The feedback control signals a need for these adjustments based on the distance measurements acquired by the strip distance sensor. These adjustments may be performed while the sheet is being pulled through the bath and around the rolls. The crossbow model may also be continuously run in order to account for any changes in variable parameters such as the strip tension throughout production. A continuously run model may be used to provide a real time reference for adjusting the correcting roll position.

In an example of a method according to the present disclosure, using for example a system having a three roll pot (a main roll and two correcting rolls), a crossbow model and strip distance sensors may be used in tandem to adjust a correcting roll position and air knife positions to provide a minimum or zero crossbow and a uniform coating thickness. At least three distance measurements taken at the same time along the width of the sheet may be used by a controller to determine the existence of a residual crossbow in the sheet. If a residual crossbow is calculated, a closed loop feedback control triggers a correcting roll adjustment/re-positioning to minimize or eliminate the crossbow based on the crossbow model output. The adjusted correcting roll position may change the distance of the sheet from the air knives (passline) which can be continuously measured by at least one strip distance sensor. The controller adjusts the position of the air knives to avoid contact with the coated sheet as the passline shifts due to the correcting roll position changes. The air knives may be configured to continuously and without delay re-adjust their position by tracking the movement of the passline based on the strip distance sensor measurements such that the distance between the air knife nozzle and coated sheet may remain relatively consistent.

I claim:

1. A method for a sheet coating process, the method comprising:

a) submerging a sheet in a coating bath of coating material;

b) contacting the sheet in the coating bath with a main roll and a correcting roll to alter the direction of the sheet and alter a crossbow in the sheet;

c) measuring distances from a select location at or near a set of air knives to a plurality of points simultaneously on the sheet transverse to the direction of travel of the sheet and downstream of the correcting roll;

d) determining by measurement the crossbow in the sheet based on the distance measurements from step c);

e) prior to submerging the sheet in the coating bath, providing a crossbow modeling curve, the crossbow modeling curve comprising solutions for a correcting roll position that provides a minimum crossbow or a zero crossbow in the sheet; and f) changing the correcting roll position relative to the main roll based on the distance measurements and the crossbow modeling curve to impart a correction in the sheet to provide a minimum crossbow or a zero crossbow in the sheet.

2. The method of claim 1, wherein changing the correcting roll position relative to the main roll is based on a crossbow model output.

3. The method of claim 2, wherein the crossbow model output is used in conjunction with the distance measurements.

4. The method of claim 1, further comprising emitting, from an air knife a select distance from the sheet, high-pressure gas at the sheet, after contacting the sheet with the correcting roll, to affect a thickness of the coating on the sheet.

5. The method of claim 4 comprising adjusting both the position of the air knife and the correcting roll position relative to the sheet.

6. The method of claim 4, further comprising correcting the position of the air knife to maintain the select distance of the air knife from the sheet based on the distance measurements.

7. The method of claim 4 wherein the measurements of the distances are taken relative to the position of the air knife.

8. The method of claim 4, wherein measuring distances to the sheet occurs at the air knives or downstream of the air knives.

9. The method of claim 4, comprising calculating a sheet coating thickness distribution based on the distances measurements.

10. The method of claim 9 comprising determining the crossbow in the sheet based on the coating thickness distribution or the distance measurements.

11. The method of claim 4 comprising re-positioning the air knives based on the distance measurements.

12. The method of claim 1, comprising measuring distances to the sheet at at least three points on the sheet, the points defining a line that is transverse to the direction of travel of the sheet.

13. The method of claim 1, wherein measuring the distances to a plurality of points on the sheet comprises taking measurements of the distance to three or more points across a width of the sheet.

14. The method of claim 1, further comprising contacting the sheet with a second correcting roll downstream of the correcting roll to alter the crossbow in the sheet.

15. The method of claim 1, further comprising calculating the correcting roll position using the distance obtained in part c) and a crossbow modeling curve, and moving the correcting roll to adjust the position of the correcting roll to provide a minimum crossbow or a zero crossbow in the sheet.

16. The method of claim 1, wherein measuring the distances to the sheet comprises emitting a laser beam at the sheet from a select location and measuring using the laser beam the distances from the select location to a plurality of points simultaneously on the sheet transverse to the direction of travel of the sheet and downstream of the correcting roll.

* * * * *